United States Patent [19]

Extra et al.

[11] 4,112,870

[45] Sep. 12, 1978

[54] APPARATUS FOR DEVELOPING ELECTROSTATIC CHARGE IMAGES

[75] Inventors: Piet M. J. Extra, Venlo-W.; Lambertus R. J. M. Smeets, Swalmen; Adrianus W. M. Van Bavel, Venlo-W.; Jacobus J. Van Lieshout, Grubbenvorst; Albert T. Deckers, Maasbree, all of Netherlands

[73] Assignee: Océ-van der Grinten N.V., Venlo, Netherlands

[21] Appl. No.: 791,158

[22] Filed: Apr. 26, 1977

[30] Foreign Application Priority Data

Apr. 26, 1976 [NL] Netherlands ..... 7604400

[51] Int. Cl.[2] ..... G03G 15/08

[52] U.S. Cl. ..... 118/657; 118/646; 118/652

[58] Field of Search ..... 118/657, 652, 646, 653, 118/644

[56] References Cited

U.S. PATENT DOCUMENTS

| | | | |
|---|---|---|---|
| 3,399,652 | 9/1968 | Gawron | 118/646 X |
| 3,664,299 | 5/1972 | Shaler et al. | 118/652 |
| 3,739,749 | 6/1973 | Kangas et al. | 118/652 X |
| 3,817,616 | 6/1974 | Whited | 118/646 X |
| 3,924,567 | 12/1975 | Koeleman et al. | 118/657 X |
| 3,926,338 | 12/1975 | Reyner | 118/646 X |
| 3,943,886 | 3/1976 | Vola et al. | 118/657 |
| 3,999,514 | 12/1976 | Abott et al. | 118/657 |
| 4,014,291 | 3/1977 | Davis | 118/657 |

*Primary Examiner*—Mervin Stein
*Assistant Examiner*—Andrew M. Falik
*Attorney, Agent, or Firm*—Albert C. Johnston

[57] ABSTRACT

An apparatus for developing electrostatic charge images on a moving support, e.g. on a photoconductive belt, by a developing powder composed of toner particles and magnetizable carrier particles, which powder is transported by a rotating magnetic roller from a reservoir through a developing zone where a magnetic roller from a reservoir through a developing zone where a magnetic brush is formed between the roller and the support, is provided with means for preventing variations of the quality of the developed images by supplying more developing powder to the brush than the roller transports through the developing zone. The excess powder flows away over a partition into a trough containing a rotor, to be remixed with powder from the reservoir and propelled by the rotor into a narrowing passage defined between the partition and the side of the magnetic roller that moves toward the support. Carrier particles staying on the support are removed by a magnetic field at the adjacent side of a nonmagnetic cylinder that bears through elastic end rings against the support at a location beyond the developing zone. Powder transported from the brush by the magnetic roller is received in a first mixing trough of a pair delivering into the reservoir, to which trough fresh developing powder is supplied for maintaining at a required value the concentration of toner particles in the developing powder. That concentration in the powder being returned on the magnetic roller is sensed, and the supply of fresh powder controlled, by an optical detecting device kept at a constant temperature above the ambient temperature. Further, frictional heat generated in powder mixed in the reservoir is dissipated by a cooling fluid passed through a double-walled bottom of the reservoir.

11 Claims, 11 Drawing Figures

APPARATUS FOR DEVELOPING ELECTROSTATIC CHARGE IMAGES

This invention relates to an apparatus for developing electrostatic charge images, of a type by which a developing powder consisting of toner particles and magnetizable carrier particles is supplied from a reservoir, with the aid of a rotating magnetic roller, to a charge image on a support moving substantially tangentially over the magnetic roller.

A known apparatus of that type, as disclosed in U.S. Pat. No. 3,943,886, has a disadvantage in that the supply of developing powder to the developing zone does not stay constant upon variations of the temperature and the humidity of the powder.

Such variations affect the transport of the powder, due to a considerable distance of travel of the developing powder between the point where it is picked up from the reservoir by the magnetic roller and the developing zone, between the magnetic roller and the image support, where the powder forms a magnetic brush. Consequently the meniscus, or accumulation of developing powder, ahead of the nip between the magnetic roller and the support is not constant in form, and differences in image quality occur because one charge image is not in contact with the developing powder as long as another charge image. Under some conditions, the rate of supply of developing powder may even become smaller than the rate of powder transport through the developing zone, so that the meniscus can even disappear entirely with a resultant very bad development of the charge image.

The principal object of the present invention is to provide a developing apparatus of the type above mentioned by which the disadvantage of said known apparatus can be avoided or at least significantly reduced.

According to the present invention, a developing apparatus of the type above mentioned is provided with a partition located near the periphery of the magnetic roller where the surface of the magnetic roller moves toward the image support, which partition together with part of the surface of the magnetic roller forms a passage narrowing in the direction toward the developing zone, and means are provided for continuously propelling developing powder from the reservoir into the wider extremity of this passage so that the amount of developing powder being supplied to the magnetic brush is always greater than the amount being transported through the developing zone. Thus, an excess of developing powder is supplied continually, so that a uniform meniscus is formed notwithstanding variations in the rate of supply or of return of the powder, and the excess of supplied powder flows away from the brush by falling away over the partition along its side turned away from the magnetic roller, without interfering with the powder being supplied to the brush.

The means for propelling the developing powder into the passage to the developing zone preferably comprise a rotor formed by a plurality of bars which coincide with generators of a cylinder and means for rotating these bars about the axis of this cylinder. In this way a further advantage is achieved in that the rotating bars subject the developing powder to a final mixing and triboelectric charging action just before the powder is carried into the zone of the brush formation, so that the magnetic brush is always formed by developing powder that is fully charged and well mixed.

According to another feature of the invention, for an embodiment in which a trough for receiving developing powder that has passed through the developing zone is located near a part of the periphery of the magnetic roller where it moves away from the image support and is provided with means for transporting this developing powder toward one end of the trough, a second trough is provided in parallel to the first, together with means for transferring the powder from said one end of the first trough into the adjacent end of the second trough, means for supplying fresh developing powder into the other end of the first trough and means for transporting the powder to a delivery opening provided in a central part of the second trough. In this way the developing powder that has passed through the magnetic brush is mixed with fresh developing powder by being stirred and moved with it in axial direction in both the first trough and the second trough, thereby rendering the powder homogeneous before it is delivered back into the reservoir.

In a preferred embodiment of the invention, in which the means for transporting powder in the first trough comprises a conveying screw, the means for transferring the powder from the first trough to the second trough comprise a conical element connected coaxially with the screw. The conical shape of this element avoids the presence in the trough of dead corners where the developing powder would accumulate.

According to another feature of the invention, a specially formed cylindrical organ containing a magnet is provided for removing magnetizable carrier particles from the image support at a location beyond the magnetic roller of the developing apparatus. Further, a specially controlled detector and a related control circuit are provided opposite to the magnetic roller for controlling the composition of the developing powder.

The above-mentioned and other objects, features and advantages of the invention will be further apparent from the following description and the accompanying drawings of an illustrative embodiment of the invention. In the drawings.

Figure 1:
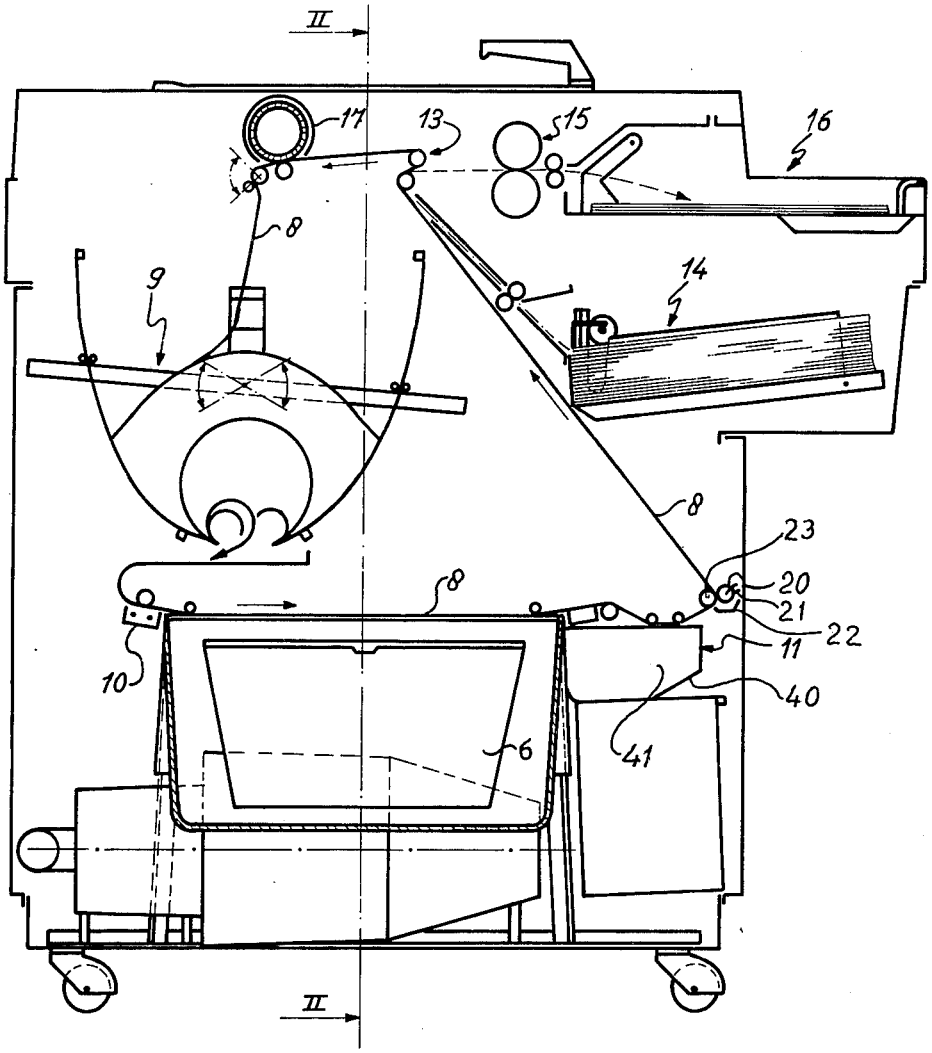
FIG. 1 is a schematic sectional view of a copying apparatus in which the illustrated embodiment of the invention is employed.
Figure 2:
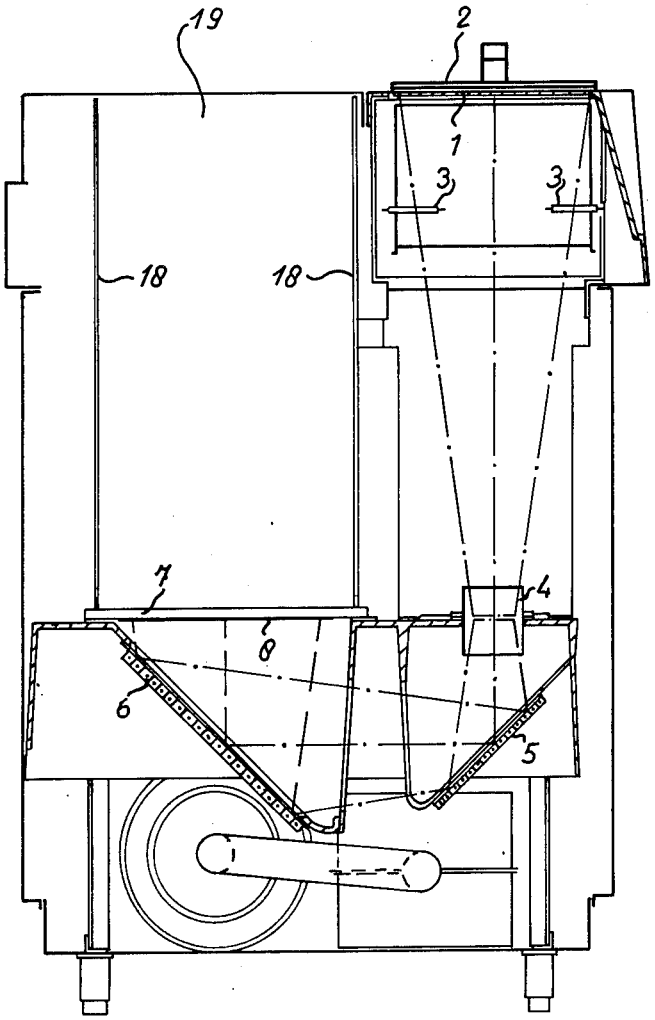
FIG. 2 is a schematic sectional view taken along line II—II of FIG. 1.

The various parts of a copying apparatus in which the invention can be employed are represented schematically in FIGS. 1 and 2 of the drawings. This apparatus is of the type disclosed in U.S. Pat. No. 3,926,625. In its use, an original to be copied is laid down on a transparent exposure plate 1 and pressed against this plate by a cover 2, and then is exposed to light from four flash lamps 3. The light image reflected by the original is projected, via an optical system comprising a lens 4 and mirrors 5 and 6, on to that portion of the photosensitive surface of an electrophotographic plate or image support which is present in the projection plane 7. The image support in this instance has the form of an endless belt 8.

The endless support 8 is transported from and back to a magazine 9 via a number of rollers, all as described more particularly in the said U.S. patent, and is moved with a constant speed in the direction of the arrows. The photoconductive surface of the belt is charged ahead of the projection plane 7 by emissions from a corona charging device 10. The projection of the light image causes the photoconductive layer to be discharged in the portions struck by the light, thus forming on the support 8 a latent electrostatic image which corresponds with the original. As the support 8 moves onwards, the latent electrostatic image passes over a developing apparatus 11 in which, with the aid of a so-called magnetic brush, developing powder is brought into contact with the surface of the support in order to develop the latent image and convert it into a powder image.

After passing the developing station, the support 8 passes over a device 20 which removes from the support 8 magnetizable carrier particles that originate from the developing powder.

Then the support carries the powder image to a transfer station at 13, where the image is brought into contact with a sheet of copy paper which is moved forward with the support 8 at the same speed, and onto which the powder image is transferred. The image transfer may be effected by use of a suitable electrical field. A sheet feeding device 14 is provided near the transfer station for transporting sheets of copy paper separately, one after another, to the transfer device.

Each sheet of copy paper passing out of the transfer station is separated from the support 8 and then passes to a fixing device 15 by which the transferred powder image is fixed onto the copy paper. Then the sheet is passed into a receiving tray 16 where it is accessible from outside the copying apparatus. Any part of the powder image which is not transferred to the sheet of copy paper is carried beyond the transfer device 13 with the support 8 and passed along a cleaning device 17 by which remnants of the image are removed from the support 8.

The electrophotographic processing steps and the transport of the support 8 all take place in a space 19 (FIG. 2) bordered by two frame plates 18 in the copying apparatus.

The copying apparatus further comprises suitable drive means and guide means for driving the support 8 in synchronism with the flash exposure of the original to be copied, for separately supplying sheets of copy paper and transporting them through the transfer device 13, and for transporting these sheets through the fixing device 15 to the receiving tray 16.

The above description is considered sufficiently representative of the general operation of one type of electrostatic copying apparatus in which the present invention may be used to advantage. It is to be understood, however, that the invention is also useful with various other types of apparatus.

The developing apparatus 11 according to the invention comprises two frame plates 41 having a form corresponding with that of two ports 40 (FIG. 1) which are provided in the frame plates 18. This enables installation of the whole developing apparatus 11 as a construction unit that can be pushed into and out of the copying apparatus, via guides (not shown), in a direction perpendicular to the plane of the drawing of FIG. 1.

Figure 3:
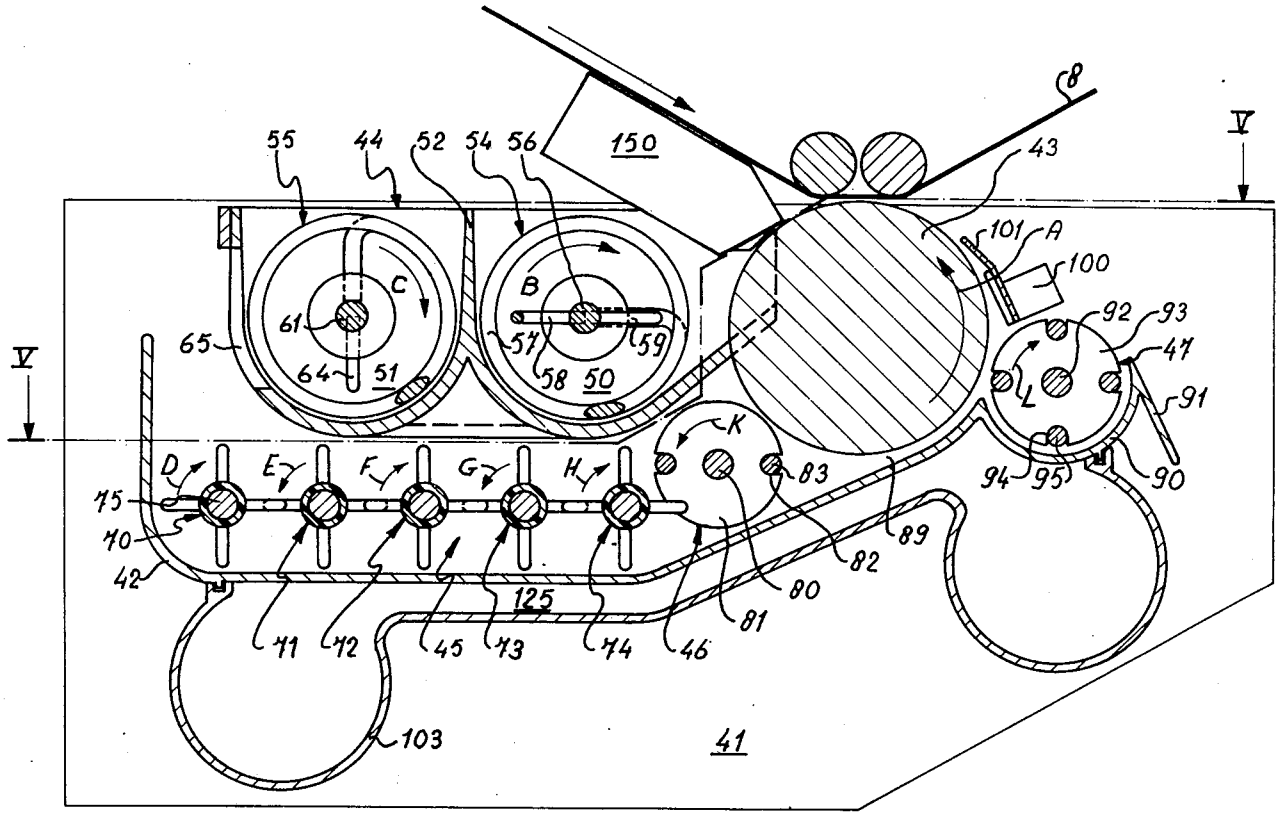
FIG. 3 is a cross section of the developing apparatus according to the invention, as employed in the apparatus of FIG. 1 and FIG. 2.
Figure 4:
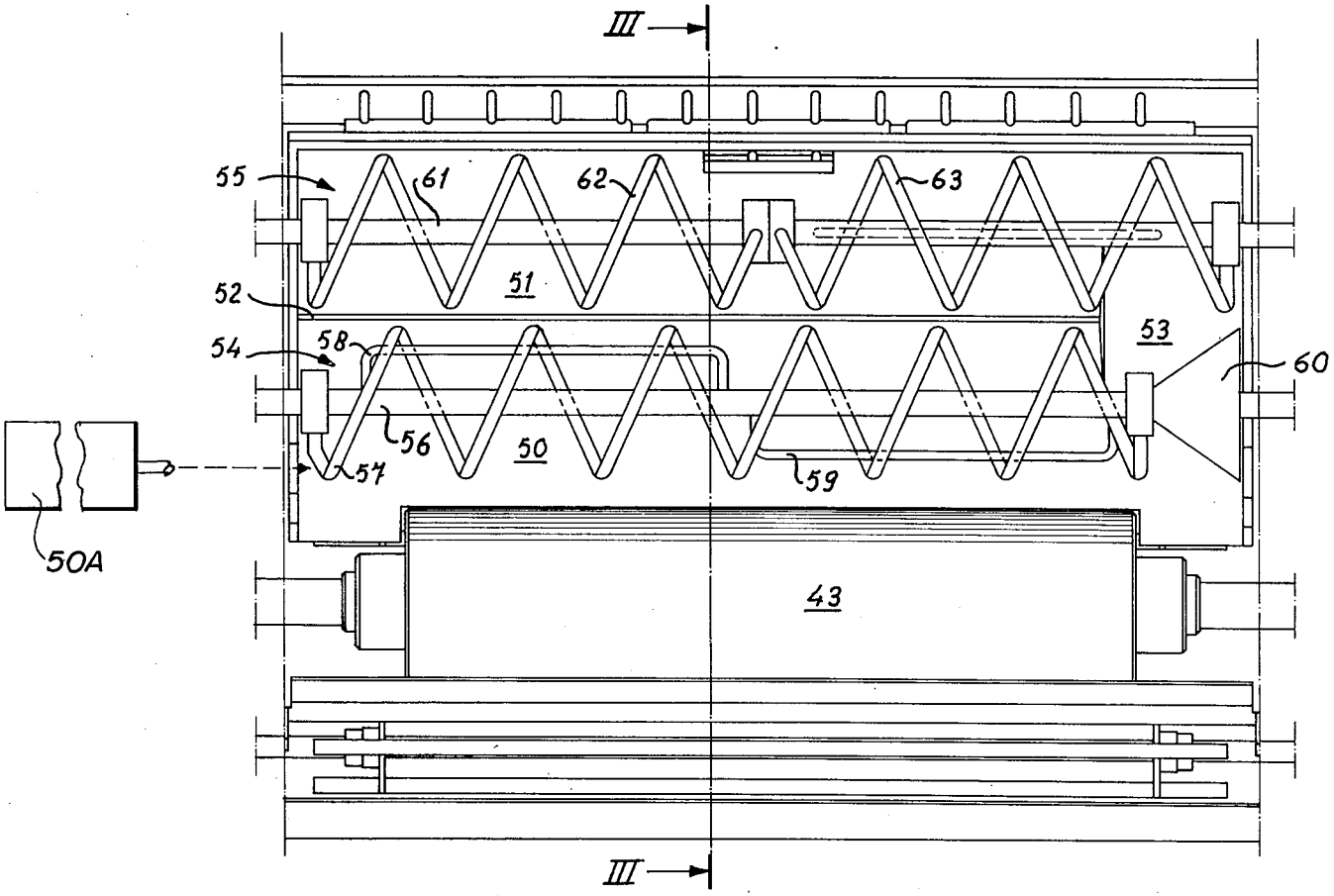
FIG. 4 is a top plan view of the apparatus of FIG. 3.
Figure 5:
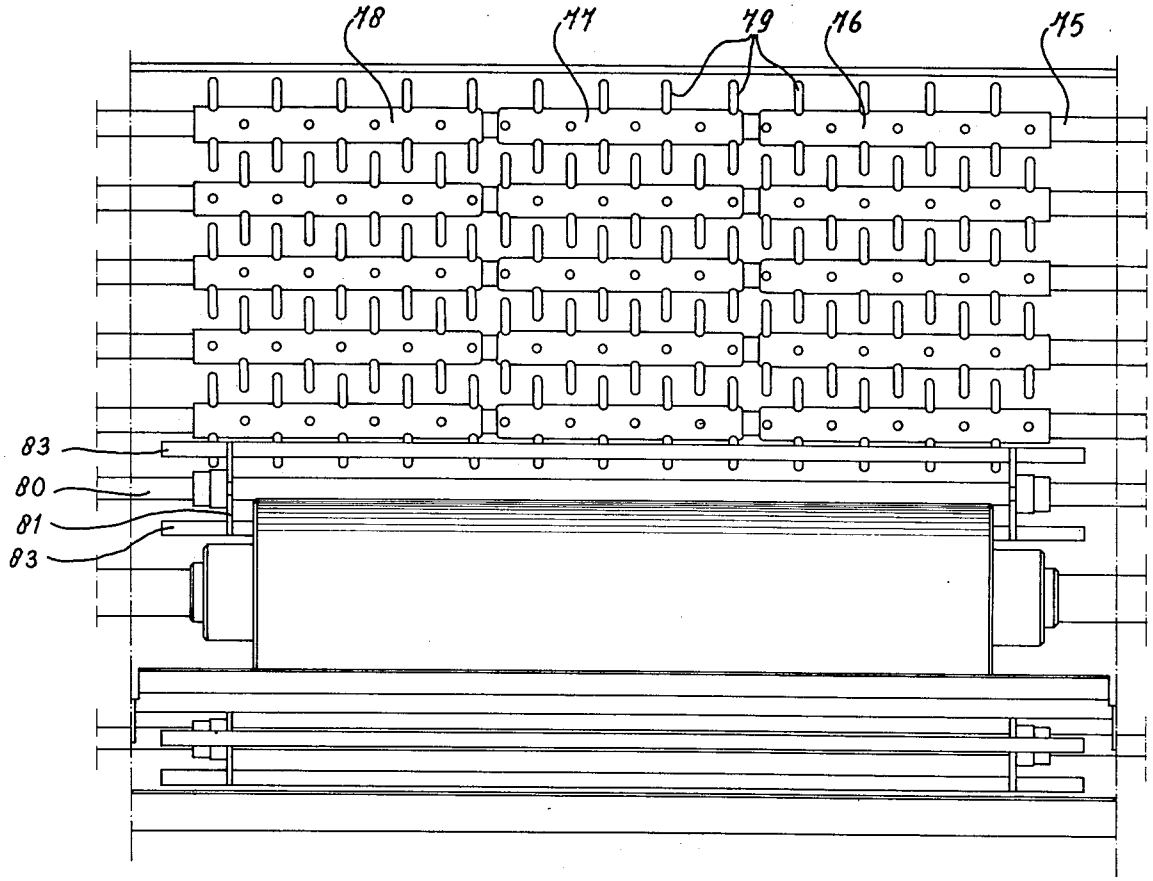
FIG. 5 is a section taken along line V—V of FIG. 3.
Figure 9:
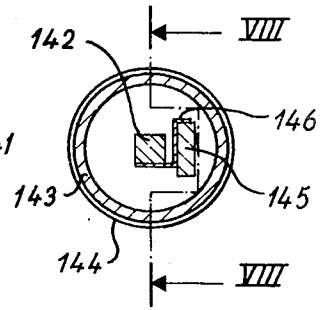
FIG. 9 is a section taken along line IX—IX of FIG. 8.
Figure 8:
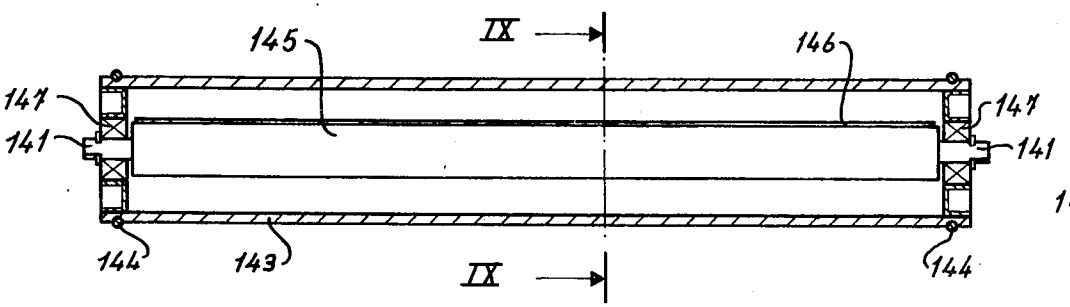
FIG. 8 is a sectional view thereof, taken along line VIII—VIII of FIG. 9.
Figure 7:
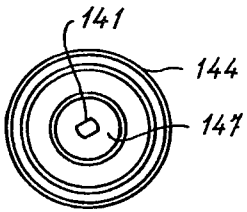
FIG. 7 is an end view of the device of FIG. 6.
Figure 6:
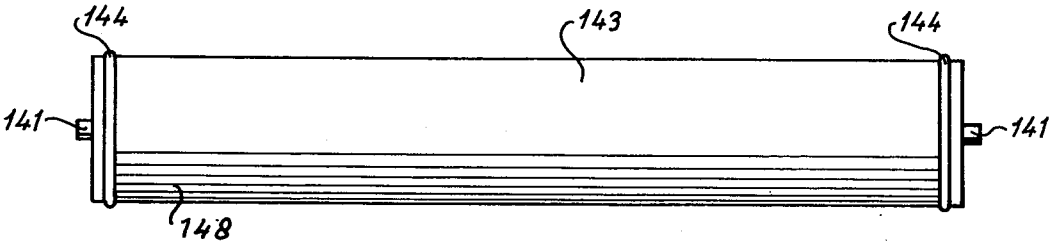
FIG. 6 is a side elevational view of a device for removing magnetizable carrier particles from the photoconductive material.

As shown in FIGS. 3, 4 and 5, a reservoir 42 for holding a supply of developing powder is mounted between the frame plates 41, and in the reservoir 42 and further between the frame plates 41 are mounted: a magnetic roller 43, a first set of mixing and transport means 44, a second set of mixing and transport means 45, a first propelling organ 46, and a second propelling means 47.

The magnetic roller 43 is mounted rotatably in bearings in the frame plates 41 and is made of nonpermanently magnetizable material and cooperates with a magnetic field generated by a magnet or magnets (not shown) so that the developing powder forms a magnetic brush in the region where the support 8 is passed tangentially over the magnetic roller. The magnetic roller 43 is driven in the direction indicated by the arrow A, and the first set of mixing and transport means 44 is installed at the side of the magnetic roller 43 where the roller surface is moving away from the support 8.

The set 44 of mixing and transport means comprises two troughs 50 and 51 having a common longitudinal wall 52, which lie beside each other and parallel to the magnetic roller 43. The common wall 52 is interrupted near one extremity of the troughs 50 and 51 to provide an open connection or passageway 53 between these troughs, and rotatable powder conveying screws 54 and 55, respectively, are provided in the troughs 50 and 51.

The conveying screw 54 comprises a shaft 56 mounted rotatably in bearings in the frame plates 41 and a transport spiral 57 extending helically about the shaft 56 and having its ends fixed firmly to the shaft 56. Two bows 58 and 59 are also fixed to the shaft 56 so as to extend along it inside the transport spiral 57, these bows being disposed at diametrically opposing sides of the shaft and each of them extending over approximately one half of the length of the shaft 56 that is covered by the transport spiral 57. The shaft 56 is also provided with a conical enlargement 60 on its end adjacent to the passageway 53 between the troughs 50 and 51.

The conveying screw 55 comprises a shaft 61 carrying two transport spirals 62 and 63 of opposite pitch, with each spiral 62 or 63 extending over one half of the length of the shaft 61. A bow 64 is fixed to the shaft 61 inside the transport spiral 63. A powder delivery or exhaust opening 65 is provided in the outer side of the trough 51 at its center.

The second set of mixing and transport means 45 is installed near the bottom of the reservoir 42 and is formed by five rotary elements 70, 71, 72, 73 and 74 which in fact are identical. Element 70, for instance, comprises a shaft 75 mounted rotatably in bearings in the frame plates 41 and having fixed on this shaft three coaxial bushings 76, 77, 78 (FIG. 5) each of which is provided with a plurality of radial pins 79 that lie in two radial planes which mutually enclose right angles.

The first propelling means 46 is rotatably mounted in bearings in the frame plates 41, at a location between the second set of mixing and transport means 45 and the magnetic roller 43. Propelling means 46 is formed by a shaft 80 having two circular flanges or discs 81 fixed to it near its ends, with two rods 83 clamped in respective, diametrically opposite recesses 82 formed in the outer circumference of each flange.

At the side of the magnetic roller 43 where the surface of the roller moves towards the image support 8, an outer portion of the wall of the reservoir 42 is formed into an arcuate trough 90 bordered along its outer side by a sloping partition 91. The second propelling means 47 is mounted in bearings in the frame plates 41, for rotation in the trough 90. This second propelling means is like means 46 in that it is formed by a shaft 92 having two circular flanges or discs 93 fixed thereon near its extremities and the flanges are provided with peripheral recesses in which bars are held spaced apart and spaced from the shaft. In the case of means 47, however, the flanges 93 are each provided with four recesses 94 which are regularly spaced apart about the outer circumference, so that four bars 95 are clamped in spaced relation to the shaft 92 for rotation in the trough 90.

A partition 101 is also provided at the side of the magnetic roller, at a location between means 47 and the support 8, so as to form with part of the surface of the magnetic roller 43 a passage that narrows in the direction toward the developing zone between roller 43 and the support 8. The partition 101 is mounted on corner stays 100 fixed to the frame plates 41.

At the other side of the magnetic roller 43, where its surface moves away from the developing zone, a detecting head 150 is provided for sensing the relative concentrations of toner particles and carrier particles in the developing powder. This detecting head is described more particularly below.

Further, suitable drive means are present for driving the various shafts in the directions indicated by the arrows in FIG. 3. Thus, the transport screws 54 and 55 are driven in the direction of the arrows B and C, respectively; the mixing elements 70, 71, 72, 73 and 74 in the directions of the arrows D, E, F, G and H, respectively; the first propelling means 46 in the direction of the arrow K; and the second propelling means 47 in the direction of the arrow L.

The operation of the apparatus described above is as follows:

The reservoir 42 is filled with a quantity of developing powder consisting of toner particles and magnetizable carrier particles. The developing powder is properly mixed by the mixing elements 70–74 and transported in the direction toward the magnetic roller 43, for which purpose the adjacent mixing elements of each pair have opposite directions of rotation. A portion of the developing powder being mixed by the element 74 is engaged by the propelling means 46 and propelled into the nip 89 between the magnetic roller 43 and the floor of the reservoir 42. This developing powder then is further transported in the nip 89 by the magnetic roller 43 while under the influence of a magnetic field produced by an auxiliary magnet (not shown), as described in U.S. Pat. No. 3,943,886. Then, at a location between the nip 89 and the zone where the magnetic brush is formed, the powder is further mixed and triboelectrically charged by the action of the propelling means 47 rotating in trough 90.

The propelling means 47 acts to propel the developing powder into the wider end of the passage formed between the partition 101 and the magnetic roller 43 at a rate greater than the rate of movement of the developing powder through the developing zone by the magnetic roller, thus causing an excess of the developing powder to be supplied continuously from the other end of said passage to the developing zone where the magnetic brush is formed. The narrowing of the passage in the direction toward the support 8, by gradual decrease of the distance between the magnetic roller 43 and the partition 101, together with the overcapacity of the propelling means 47, assures this continuous supply of excess developing powder to the magnetic brush. The amount of supplied developing powder in excess of that required at any moment to maintain the magnetic brush flows downward over the partition 101 without interfering with the developing powder supplied into the brush. Consequently, the meniscus of developing powder between the magnetic roller 43 and the image support 8 in the developing zone is kept uniform, and the development of electrostatic charge images into powder images always takes place under similar conditions.

The developing powder that flows away over the partition 101 falls into the trough 90, in which it is mixed by the propelling means 47 with the developing powder entering from the nip 89. The illustrated embodiment of the propelling means 47 is especially suited for this remixing, as compared with more closed forms of propelling devices. As an excess of developing powder is built up in the trough 90 by the supply from the nip 89 and the overflow over the partition 101, excess powder passes out of the trough 90 over the partition 91 to be collected below the latter. It has been observed that, principally, magnetizable carrier particles are removed in this way from the trough 90.

The developing powder that has been transported by the magnetic roller 43 past the support 8 is received in the trough 50, where it is mixed with a so-called premix of fresh developing powder and is transported to one extremity of the trough 50 by the conveying screw 54. The powder is also intermixed in trough 50 by the bows 58 and 59. The premix is supplied by suitable known means illustrated schematically at 50A in FIG. 4, preferably of the type disclosed in the British patent specification No. 1,349,729, which are actuated in accordance with a signal of the concentration detecting device 150.

The mixture of used developing powder and premix is passed from the end of trough 50 into the trough 51, via the passageway 53, with the aid of the conical device 60. The conical shape and the rotation of the device 60 cause the developing powder to flow readily from trough 50 into trough 51, without accumulating in dead corners. Then from the right end of trough 51 as viewed in FIG. 4 the developing powder is further transported by the conveying spiral 63 to the center of the trough 51, where it falls downward into the reservoir 42 through the exhaust opening 65. Thus, an effective mixing of the powder returned past the magnetic brush and the premix added in trough 50 takes place over the whole length of the trough 50 and over half of the length of trough 51. The conveying spiral 62 prevents developing powder moved past the exhaust opening 65 from remaining long in the left-hand extremity of the trough 51.

The powder mixture delivered through opening 65 into the reservoir 42 is further mixed by the elements 70–74 with the quantity of developing powder present in the reservoir and is thus transported toward the magnetic roller. This mixing is effected very intensively in order to keep the developing powder highly homogeneous and to obtain a maximum triboelectric charging effect. As a result of this mixing, there is much rubbing with friction between the individual particles, which not only results in the desired homogenization and triboelectric charging but also in the generation of frictional heat. This leads to an increase of the temperature of the developing powder, which increase becomes unacceptable in the absence of sufficient heat dissipation because the developing process is temperature-dependent and is optimal only in a certain temperature range. According to the invention, the bottom of the reservoir 42 is made double-walled, with a lower wall 103 which forms a cooling space 125 through which a stream of air is maintained. For instance, a ventilator (not shown) sucks out of the space 125, via an outlet opening, air admitted into space 125 through an inlet opening provided in the wall 103. In this way the frictional heat is conducted away and the temperature increase in the developing powder is kept within acceptable limits.

In the course of developing electrostatic charge images on an endless support such as a belt 8 with a developing powder comprising a mixture of toner particles and magnetizable carrier particles, unavoidably, a few of the carrier particles are picked up by the support. These carrier particles tend to damage the support, causing surface imperfections which become visible as white points or stripes on copies produced, and they can also give rise to troubles in the copying apparatus. In order to prevent these adverse effects, a devise 20 (FIG. 1) is provided at a location beyond the developing zone for removing magnetizable carrier particles from the support 8. The device 20, as shown in FIGS. 6–9, comprises a cylinder 143 made of nonmagnetizable material, which is rotatable on bearings 147 about a shaft 142. The shaft 142 is provided at its ends with flattenings 141 which fit slidingly into grooves or slots 21 in the frame plates 18, and a bar magnet 145 is mounted on the shaft 142 inside the cylinder 143 by an angled support, or bow, 146 of magnetizable material. On the outer surface of the cylinder 143, near its ends, rings 144 of rubber or like material are provided, as by being held in peripheral grooves, so as to protrude a short distance from said surface and thus bear against marginal portions of the support 8. In this way, the cylinder 143 and the support 8 are kept spaced apart at a constant distance suited for the effective removal of magnetizable carrier particles from the support by the magnetic field of the magnet 145, without opportunity for the spacing to become greater so that the magnetic field strength of the magnet 145 at the surface of the support 8 would become too small and let such particles be carried onward by the support. The rubber rings 144 also cause the cylinder 143 to start rotating as soon as the support 8 starts moving, so that no separate drive is needed for the rotation of the cylinder 143. The sliding fit of the flattenings 141 on the ends of shaft 142 in the frame plate grooves 21 and the slope of these grooves 21 toward the support 8 cause the cylinder 143 always to be pressed with its rubber rings 144 bearing against the support 8, and cause the magnet 145 on the shaft 142 always to occupy the same position relative to the support 8. This position preferably is one in which the maximal magnetic field strength measured at the surface of the cylinder 143 is located at the side of the cylinder 143 facing the support. Of course, if desired, the cylinder 143 can be arranged so that the rubber rings 144 will press against the roller 23 or any other element moving with the support 8.

The magnetizable bow 146 is mounted on the shaft 142 in a position such that the minimal field strength of the magnet 145 is at the side of the cylinder 143 directed away from the support 8. Consequently, the magnetizable carrier particles removed from the support 8 by the magnet 145 are not kept caught in the magnetic field of the magnet 145 but are carried along by the cylinder 143 toward its side directed away from the support 8, where they fall down from the cylinder 143 due to the absence of a magnetic field and to a magnetic field-insulating effect of the bow 146. The particles thus removed are collected in a receiving tray 22. Preferably the surface of the cylinder 143 is profiled in tangential direction to aid in carrying along the carrier particles through the magnetic field and shedding of them outside the magnetic field. Profilation is achieved by knurling, grooving or otherwise roughening the surface. Grooves for example are shown as 148 in FIG. 6.

Figure 10:
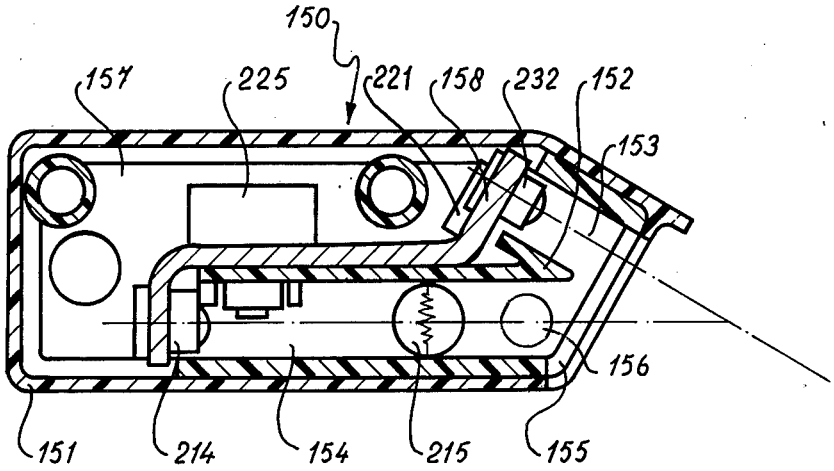
FIG. 10 is a sectional view of a detecting head used according to the invention for controlling the concentration of the powder mixture.

The detecting head 150 serves for the control of the toner concentration in the developing powder. This device, as shown in FIG. 10, comprises a housing 151 containing a light source 215 and two light-sensitive elements 214 and 232. The first element 214 is directly irradiated by the light source 215 and cooperates with a circuit 201 (FIG. 11) to keep the brightness of the light source 215 constant. The second element 232 is irradiated by the light source 215 via reflection from the developing powder in the brush at the developing zone, and cooperates with a control circuit 203 which emits a commanding signal to the device 50A for supplying developing powder to the trough 50, thereby actuating that device from time to time so as to keep the ratio of toner particles and carrier particles in the developing powder substantially constant.

The housing 151 of the detecting head 150 further contains a black, light-impervious partition 152 which divides the housing 151 into two channels 153 and 154 that extend from a common opening 155 in an end of the housing. The light source 215 is located in channel 154. A side wall of the housing 151 is made with an opening 156 through which air is blown to create a small excess pressure in the housing 151, thereby preventing developing powder from entering the housing through opening 155. The housing 151 also contains a space 157 occupied by some of the electronic elements of the control system for controlling the toner concentration. This space is separated from the channels 153 and 154 by a highly heat-conductive partition 158 which for instance is made of brass. The partition 158 has angled end portions made with two openings in which, respectively, the light-sensitive elements 214 and 232 are mounted in good thermal contact with the partition 158. Further, a power transistor 225 is supported on the partition 158.

The transistor 225 cooperates with a circuit 202 (FIG. 11) and with a temperature-sensitive element 221, which also is mounted on the partition 158, so as to keep the partition 158 at a constant temperature lying about the ambient temperature. In this way, the light-sensitive elements 214 and 232 are also kept at this constant temperature, so that any difference of response of the elements 214 and 232 that might result from temperature differences is eliminated. Consequently, the units to be used as these elements can be picked at random without need for the selection of a pair of light-sensing elements having identical temperature-dependence. Moreover, electronic elements in the space 157 are now less sensitive to variations in the ambient temperature, thereby assuring a greater stability in their functions.

The operation of the concentration control system will be further apparent from the description below and the diagram of FIG. 11.

Figure 11:
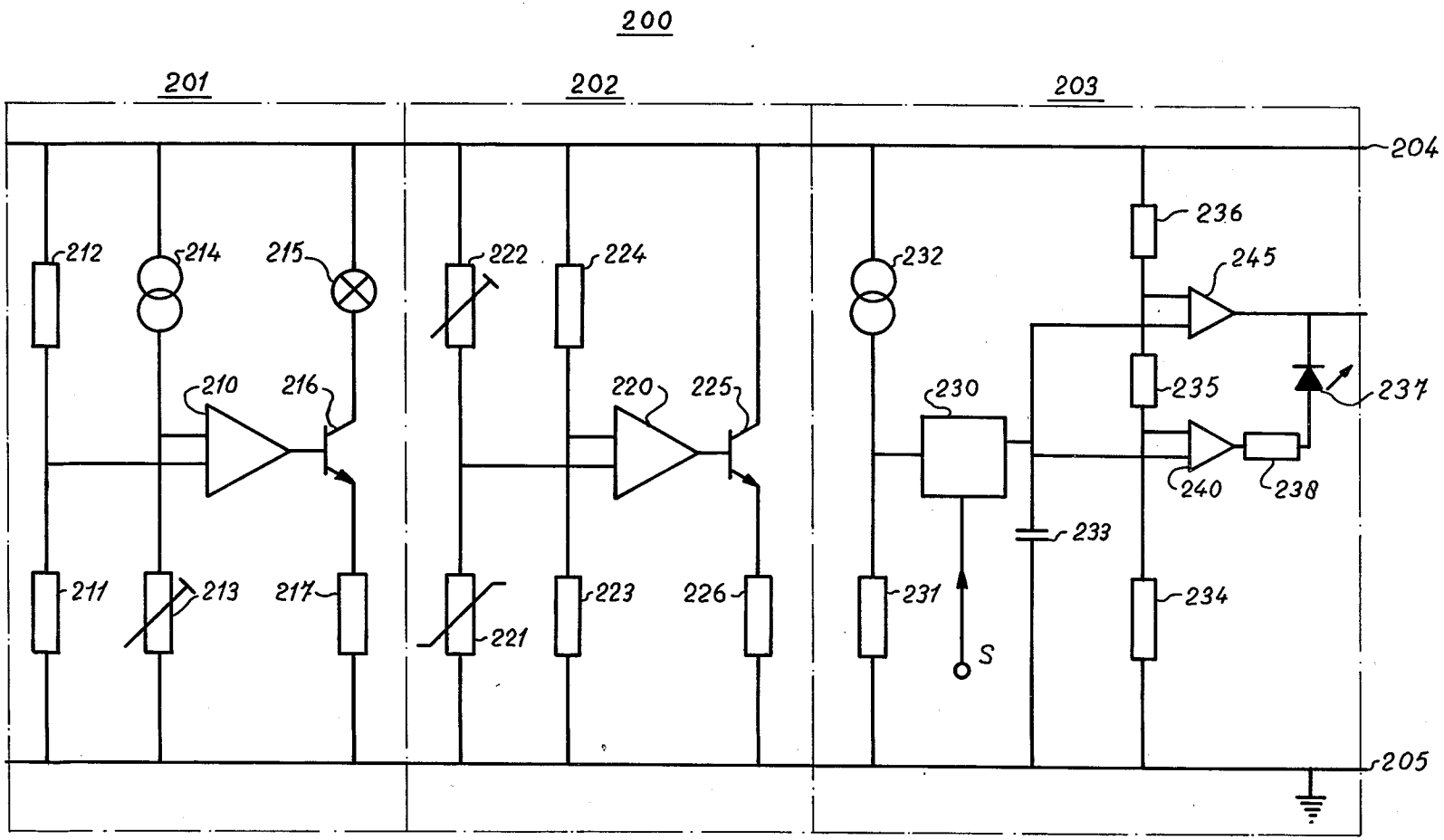
FIG. 11 is a schematic diagram of an electrical circuit suitable for use according to the invention to control the toner concentration.

The circuit 200 of FIG. 11 comprises three partial circuits, namely: a circuit 201 which keeps the quantity of light emitted by the light source 215 at constant value, a circuit 202 which keeps the temperature of the partition 158 and of the light-dependent resistors 214 and 232 at a constant value, and a circuit 203 which measures the toner concentration in the developing powder and emits a commanding signal tht actuates the device for supplying a mixture of toner particles and carrier particles to the developing apparatus. The three partial circuits are connected via voltage lines 204 and 205 with, respectively, the positive pole and the negative pole of a voltage source. The negative pole is also grounded.

The circuit 201 comprises a first, fixed voltage-divider, which is formed by resistors 211 and 212, and a second, variable voltage-divider which is formed by an adjustable resistor 213 and the light-dependent resistor 214. The junction of the resistors 211 and 212 is connected with the noninverting input of an operational amplifier 210, while the junction of the resistors 213 and 214 is connected with the inverting input of the operational amplifier 210. The output of the operational amplifier 210 is connected with the base of the transistor 216. The emitter of the transistor 216 is connected with the negative voltage line 205 via the resistor 217, and with the positive voltage line 204 via the light source 215. When a diminution of the light output of the light source 215 occurs, such for instance as occurs through aging of the light source 215, the light-dependent resistor 214 receives less light and the resistance value of this resistor increases. As a result of this resistance increase the voltage on the junction of the resistors 213 and 214 decreases. As this junction is connected with the inverting input of the operational amplifier 210, the voltage at the output of the operational amplifier 210 increases. By this increase an increased current starts flowing through the transistor 216 switched as emitter follower. This increased current also flows through the light source 215, so that the light source 215 starts emitting more light.

Upon an increase in the brightness of the light source 215, its brightness will be brought back to the equilibrium value in an analagous way; so a light source having a substantially constant brightness is obtained. The equilibrium value of this brightness can be adjusted by resetting the adjustable resistor 213, which resistor co-determines the voltage on the junction of the resistors 213 and 214 and, consequently, the output voltage of the operational amplifier 210. It will be apparent to skilled persons that the circuit configuration here shown in only one of many possible configurations and combinations of the various resistors and other circuit components which would be suitable for achieving the same effect.

The circuit 202 also comprises a first, fixed voltage divider, which is formed by the resistors 223 and 224, and a second, variable voltage divider which is formed by an adjustable resistor 222 and the resistor 221 having a negative temperature coefficient. The junction of the resistors 221 and 222 is connected with the noninverting input of an operational amplifier 220, and the junction of the resistors 223 and 224 is connected with the inverting input of the operational amplifier 220. The output of the operational amplifier 220 is connected with the base of the power transistor 225. The emitter of the transistor 225 is connected with the negative voltage line 205 via a resistor 226, and the collector is directly connected with the positive voltage line 204. The power transistor 225 is fixed in good thermal contact on the partition 158, as well as resistor 221 and the light dependent resistors 214 and 232. Partition 158 being made of good heat conductive material, this partition, the resistors 214, 221, 232 and the transistor 225 always have substantially the same temperature, which temperature is kept constant with the aid of partial circuit 202. For instance, if the temperature of the partition 158 decreases, the resistance value of the resistor 221 increases and causes the voltage on the junction of the resistors 221 and 222 to increase, with a consequent increase of the output voltage of the operational amplifier 220. This in turn increases the dissipation of the transistor 225 and the temperature of the partition 158 having the circuit components installed on it, so that the initial temperature decrease is compensated. A fully analogous compensation takes place upon an increase of the temperature of the partition 158.

The circuit 203 responds to an input signal corresponding to the voltage on the junction of a voltage divider formed by a fixed resistor 231 and the light-dependent resistor 232. The junction of these two resistors is connected with the input of a gate circuit 230, the output of which is connected with the noninverting inputs of two operational amplifiers 240 and 245 having high amplifications, and also with a capacitor 233. The other side of the capacitor 233 is connected with the negative voltage line 205. Further, a second voltage divider is provided which is formed by resistors 234, 235 and 236. The junction of the resistors 234 aand 235 is connected with the inverting input of the operational amplifier 240, while the junction of the resistors 235 an 236 is connected with the inverting input of the operational amplifier 245. The output of the operational amplifier 240 is connected via a resistor 238 with the anode of a light-emitting diode 237, the cathode of which is connected with the output of the operational amplifier 245. The operation of the circuit 203 is explained in the following paragraphs.

The light-dependent resistor 232 is irradiated by light being received from the light source 215 by reflection from the magnetic brush. The quantity of light emitted by this light source is kept constant, and since the circuit 202 keeps the resistor 232 at a constant temperature no variations can occur in the resistance value of the resistor 232 as a result of temperature variations. The level of the temperature so maintained is kept sufficiently high, above the highest ambient temperature occurring, to prevent disadjustment by an ambient temperature higher than the temperature set by adjustment of resistor 222. Consequently, the resistance value of resistor 232 changes only when the quantity of light reflected by the magnetic brush changes.

A change of this quantity of relfected light occurs whenever there is a change of the relative concentration of toner particles and magnetizable carrier particles in the magnetic brush, as these two kinds of particles have different coefficients of light reflection. Consequently, the voltage on the junction of the resistors 231 and 232 is a measure of the ratio of toner particles to carrier particles.

During the development of an electrostatic charge image the ratio of toner particles to carrier particles in the powder being returned from the brush changes continually. These are appreciable changes which would cause the concentration control system continually to emit signals commanding the supply device 50A to deliver fresh developing powder. These changes, however, occur in only a small quantity of powder and can easily by leveled off by the relatively great amount of powder in the reservoir. Only the ratio of toner particles to carrier particles in the powder in the reservoir is determinative for supplying or not supplying fresh developing powder. To prevent the control system from reacting to incremental changes in the ratio of toner particles to carrier particles that result during the development of an electrostatic charge image, the voltage on the junction of the resistors 231 an 232 is not allowed to enter into the circuit 203 in those intervals when a charge image is being developed. A blocking of that voltage is effected by the gate circuit 230, which for instance may comprise a buffer amplifier followed by a field effect transistor commanded by a single S. The signal S is generated elsewhere in the copying apparatus in timed relation to an exposure of the support 8 for the formation of an electrostatic charge image to be developed; for instance, as described in Dutch patent application No. 7311992. It will be apparent that various other arrangements can be provided for the gate circuit 230.

During the signal blocking condition of the gate 230 the capacitor 233 retains the voltage latest present on the output of the gate 230 in the signal-transmitting condition. In this way the course of the output signal of the circuit 203 is kept continuous in time, notwithstanding the discontinuities of the input signal which result from openings and closings of the gate 230.

The circuit elements shown in the right half of the diagram of circuit 203 have three different possible final states. The first state occurs when there proportionally are too many toner particles. Then the light-dependent resistor 232 is struck by a relatively small amount of light and this resistor has a relatively great resistance value. The voltage on the junction of the resistors 231 an 232 then is low as well as the output voltage of the gate circuit 230, which output voltage is lower than the voltage on the junction of the resistors 234 and 235. Because of the high amplification the voltages at the outputs of both operational amplifiers are equal and are almost equal to the negative voltage of the voltage line 205; so the light-emitting diode 237 does not emit light. As a consequence of the low output voltage of the operational amplifier 245, which is the commanding signal, no fresh developing powder is supplied.

The second state of circuit 203 occurs when there proportionally are too few toner particles. In that case relatively much light is reflected towards the light-dependent resistor 232, which consequently becomes of low resistance value. Then a voltage higher than the voltage on the junction of the resistors 235 and 236 is supplied via the gate 230 to the noninverting inputs of the operational amplifiers 240 and 245; so the voltages on the outputs of both operational amplifiers 240 and 245 are equal and are almost equal to the positive voltage of the voltage line 204, and again the light-emitting diode 237 does not emit light. As a consequence of the high output voltage of the operational amplifier 245, the commanding signal, fresh developing powder is now supplied from denise 50A to the developing apparatus.

The third state of circuit 203 occurs when there are just sufficient toner particles in proportion to the carrier particles. Then the resistance value of the light dependent resistor 232 is such that the value of the output voltage of the gate 230 lies between the voltage present on the junction of the resistors 234 and 235 and the voltage present on the junction of the resistors 235 and 236. The value of the voltage over the resistor 235 is determined by the relation of the resistance value of the resistor 235 to the resistance value of the resistors 234 and 236. In this third state the output voltage of the operational amplifier 240 is almost equal to the positive voltage on the voltage line 204, and the output voltage of the operational amplifier 245 is almost equal to the negative voltage on the voltage line 205. In this case the light-emitting diode 237 emits light to show that the proper ratio of toner particles to carrier particles is present in the magnetic brush.

The light-emitting diode 237 can also be used with the aid of the adjustable resistor 213 for setting the light intensity of the light source 215. For that purpose the proper ratio of toner particles to carrier particles must be present in the magnetic brush. When then the resistor 213 is adjusted in such a way that the light-emitting diode 237 emits light, a proper setting of the toner concentration control system is completed in a very simple way.

We claim:

1. In an apparatus for developing electrostatic charge images on a moving support, including a reservoir for holding a developing powder composed of toner particles and magnetizable carrier particles and a rotating magnetic roller for transporting powder from the reservoir through a developing zone wherein the support moves substantially tangentially over the magnetic roller, means at the side of said roller where its surface moves toward said zone for supplying developing powder to said zone at a rate greater than the rate of transport of powder through said zone by said roller, said means including a partition forming with part of the surface of said roller a passage narrowing in the direction toward said zone and means for propelling powder from a part of the reservoir into the wider end of said passage.

2. Apparatus according to claim 1, said propelling means comprising a rotor formed by a plurality of bars spaced from and spaced apart about a common axis and means for rotating said bars about said axis.

3. Apparatus according to claim 2, said reservoir having a bottom portion forming a trough at said side of said roller and said rotor being mounted for rotation in said trough.

4. Apparatus according to claim 3, said partition and said trough being so disposed that excess powder supplied to said zone flows away over the side of said partition away from said roller and falls through said rotor into said trough.

5. In an apparatus according to claim 1 and further including near the side of said roller that moves away from said zone a trough for receiving powder carried from said zone by said roller and means for transporting powder received in said trough towards one end of said trough; means for supplying fresh developing powder into the other end of said trough, a second trough extending along said receiving trough, means for transferring powder from said one end of said receiving trough into an adjacent end of said second trough, an opening in a central portion of said second trough for delivering powder therefrom into said reservoir, and means in said second trough for transporting powder therein to said opening.

6. Apparatus according to claim 5, the first-mentioned transporting means comprising a powder conveying screw in said receiving trough and said transferring means comprising a passageway between said one end and said adjacent end and a conical organ coaxial with said screw for directing powder in said one end into said passageway.

7. Apparatus according to claim 1 and further including magnetic means adjacent to the path of movement of said support at a location beyond said magnetic roller for removing magnetizable carrier particles from said support, said magnetic means comprising a rotatably mounted hollow cylinder of nonmagnetizable material and a stationary magnet arranged inside said cylinder so that its magnetic field strength on the surface of said cylinder is maximal at the side of said cylinder directed toward said support, said cylinder having annular pnotnusions extending about it near its extremities, and means biasing said cylinder toward said path so that said pnotnusions bear against and are moved with said support.

8. In an apparatus according to claim 1 and further including detector means positioned opposite to said magnetic roller for sensing the relative concentrations of toner particles and carrier particles in the powder carried on said roller from said developing zone, which detector means comprises a light source, a first light-sensitive element directly irradiated by said light source, a first control circuit coacting with said first element to keep the brightness of said light source constant, a second light-sensitive element irradiated by reflection of light from said source from said powder on said roller, and a second control circuit coacting with said second element to emit a signal for causing fresh developing powder to be supplied to the developing apparatus, means operative during the development of a charge image on said support for blocking the signal emission of said second control circuit.

9. Apparatus according to claim 8, said signal blocking means comprising a gate circuit between said second light-sensitive element and said second control circuit and a memory element.

10. Apparatus according to claim 9, said memory element being a capacitor.

11. Apparatus according to claim 1, said reservoir having a double-walled bottom forming a space for holding a fluid in heat exchange with powder in said reservoir, and means for passing a cooling fluid through said space.

* * * * *

UNITED STATES PATENT OFFICE

CERTIFICATE OF CORRECTION

Patent No. 4,112,870 Dated September 12, 1978

Inventor(s) Piet M. J. Extra, et al

It is certified that error appears in the above-identified patent and that said Letters Patent are hereby corrected as shown below:

Abstract: Line 6, delete "magnetic roller"
Delete line 7.

Column 4, line 15, in place of "organ" read -- means --.
Column 8, line 57, in place of "about" read -- above --.
Column 9, line 54, in place of "in" read -- is --.
Column 10, line 34: in place of "aand" read -- and --.
line 58: in place of "relfected" read -- reflected --.
Column 11, line 64: in place of "denise" read -- device --.
Column 13, lines 17, 18 and 20: in place of "pnotnusions" read -- protrusions --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*